United States Patent [19]

Pran et al.

[11] 3,977,352

[45] Aug. 31, 1976

[54] HIGH SEA VESSEL HAVING TANNING AND CARGO CARRYING CAPABILITIES

[75] Inventors: Nils Beylegaard Pran; Björn Johnsrud; Leif Pran, all of Oslo, Norway

[73] Assignee: N.B. Pran, Oslo, Norway

[22] Filed: Nov. 21, 1974

[21] Appl. No.: 526,045

[30] Foreign Application Priority Data

Nov. 26, 1973 Norway ..... 4494/73

[52] U.S. Cl. ..... 114/235 R; 114/56; 114/72

[51] Int. Cl.[2] ..... B63B 35/66

[58] Field of Search ..... 114/235 R, 235 A, 236, 114/56, 72, 73, 151, .5 R, .5 D

[56] References Cited

UNITED STATES PATENTS

| | | | |
|---|---|---|---|
| 1,412,202 | 4/1922 | Adams | 114/235 R |
| 1,772,612 | 8/1930 | McDougall | 114/72 |
| 1,973,719 | 9/1934 | Lake | 114/235 A |
| 2,401,126 | 5/1946 | Weaver et al. | 114/56 |
| 2,902,966 | 9/1959 | Baer | 114/235 R |
| 3,162,168 | 12/1964 | Ferris et al. | 114/72 |
| 3,440,990 | 4/1969 | Van Riet et al. | 114/72 |

*Primary Examiner*—Stephen G. Kunin
*Assistant Examiner*—Charles E. Frankfort
*Attorney, Agent, or Firm*—Fleit & Jacobson

[57] ABSTRACT

A sea going vessel, particularly adapted to serve as a supply and servicing ship for off-shore drilling platforms by fulfilling towing, anchor handling, and cargo carrying functions, wherein the propulsion and steering equipment is positioned in the forward portion of the vessel, a keel fin is provided underneath the aft portion of the hull, the deck house is located at a substantial distance aft from both the bow and the steering and propulsion equipment, the towing and anchor handling equipment is located aft of the deck house, and the cargo carrying space is located forward of the deckhouse.

3 Claims, 1 Drawing Figure

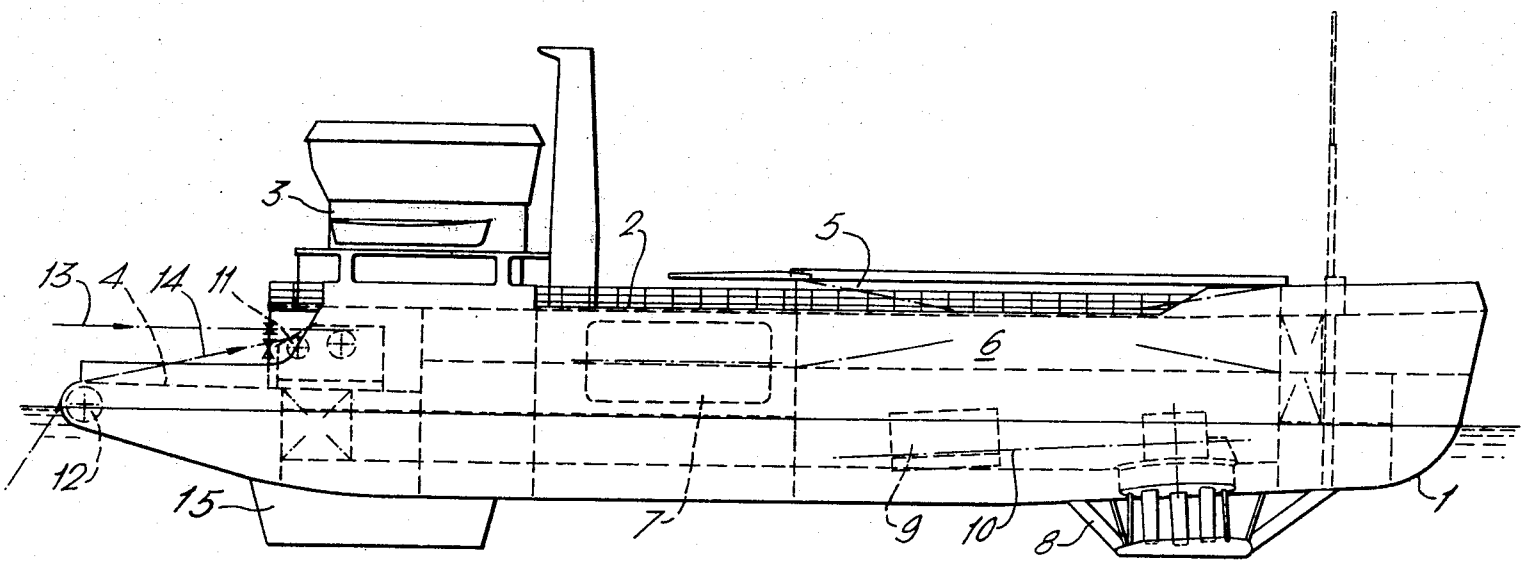
1
2
3
4
5
6
7
8
9
10
11
12
13
14
15

HIGH SEA VESSEL HAVING TANNING AND CARGO CARRYING CAPABILITIES

The present invention relates to a seagoing vessel adapted to serve as a supply vessel to the so called "off-shore" installations, such as oil or gas drilling platforms, for the towing of such platforms, but also for ordinary high sea towing, as well as for handling of mooring anchors for such installations.

The vessels now in ordinary use for the purposes mentioned, are provided with a larger free aft deck and a wheel and accommodation house as far forward as possible. Such vessels are suffering of a number of serious deficiencies. The aft deck is without protection against the sea, the free board is small and it is not to be prevented that water would enter the deck, thereby reducing the stability of the vessel, and cargo on deck and crew having to work on the deck are liable to be damaged.

When such vessels carry cargo on the aft deck, they are not capable to serve as towing or anchor handling.

Due to the positioning of the wheel and accommodation house as far forward as possible, this house is directly subjected to head sea which may break the bridge windows and flood the wheel house.

The subject of the present invention is a vessel particularly adapted to serve as a supply and servicing vessel for off-shore drilling platforms by fulfilling towing, anchor handling, and cargo carrying functions. The vessel is characterized by the following relative positioning of its parts which greatly facilitates carrying out these functions in a single vessel: the propulsion and steering means are positioned in the forward part of the vessel, a keel fin is positioned underneath the aft section of the vessel, a space for carrying large and bulky cargo both under and over the topmost deck is provided in the forward section, a wheel and accommodation space (deck house) is located aft from the cargo space, and the towing and anchor handling means are located aft from the deck house in or near the stern.

Due to the fact that the propulsion and steering means, which by way of example may be a propeller or two propellers of the Voith-Schneider type, water jet devices, jet devices or other propeller devices capable of combining propulsion and steering effects are arranged in the forward part of the vessel, with the towing means fully aft, a very good manoeuvrability during towing is achieved. By the arrangement of cargo space both under and above deck, not only a relatively short vessel is obtained, but also a structurally suitable height above the water line, to the effect that the cargo may be carried fully protected in part in ordinary holds and in part at a good height above the water line, so as to be protected against the sea far better than when carried on the ordinary low aft deck. Due to the fact that the deck house is positioned aft in the vessel, it is not substantially subjected to be directly hit by head seas, so that the bridge with its equipment is well protected, and the conditions in the crew accommodations are comfortable.

Due to the fact that the aft deck is not intended for the carrying of cargo, the towing and anchor handling means will have a free run in the aft direction, to the effect that the vessel may be used for towing or anchor handling purposes even when in loaded condition, and with no danger that wires, tows or chains be engaged in aft positioned propulsion or steering means. Consequently, the aft deck may be made comparatively short, so that possible water flooding will be of scarce effect to the stability of the vessel.

Due to the fact that the bridge is provided with windows facing both forward and aft, possibly also with a double equipment of manoeuvering means, the bridge provides possibilities of supervision of all the services which the vessel has to provide.

In order further to improve the manoeuvrability of the vessel during towing, it is convenient to position the towing and anchor handling equipment nearer to the water line than the weather deck above the cargo holds.

In the preferred embodiment, the main machinery for the propulsion means is positioned in the forward part of the vessel. This obviates long power transmission shafting, increases the weight of the forward section when the vessel is not carrying cargo, and allows the use of stabilizing tanks in the hull.

With reference to the accompanying drawing, which illustrates a vessel in a side view, in part with interior installations, a vessel according to the invention is now to be described.

In this description only such features which are of importance to the understanding of the invention are to be mentioned, while the remaining parts of the vessel will be readily understood from the drawing by those skilled in the art.

In the drawing, 1 is the vessel hull, with weather deck 2, deck house 3 and aft deck 4. The weather deck 2 is adapted to carry deck load 5, such as steel structures, tubes, containers or the like, and in the hull 1 comprises holds 6 and tanks 7. In the embodiment shown in the drawing, all load carrying space, both above and underneath deck, is provided forward of the deck house 3.

In the embodiment shown the propulsion and steering means 8 is indicated as being of the Voith-Schneider propeller type, but as mentioned above, other types of such means may be adopted. The main machinery for the means 8 is indicated at 9 and is positioned just aft of the means 8 so as to make the length of the transmission shaft 10 as short as reasonably possible. The means 8 may be in the form of one, or as shown, a pair of propeller means, with corresponding one or a pair of main machinery 9.

The towing and anchor handling gear 11 is positioned on the aft deck 4, just aft of the deck house 3 and comprises winches, drums etc. as well as a guide drum 12 on the stern. A towing rope is indicated at 13 and an anchor handling wire at 14.

In the keel line, underneath the towing and anchor handling means 8, a keel fin 15 is provided for the purpose of improving the manoeuvrability of the vessel, in particular when the means 8 is of the Voith-Schneider type.

We claim:

1. A sea going vessel, particularly adapted to serve as a supply and servicing vessel for off-shore drilling platforms through the capability of fulfilling with one ship towing, anchor handling, and load carrying functions, comprising:

an underlying hull structure, propulsion and steering means which are positioned in and underneath the forward portion of the hull structure, a keel fin positioned underneath the aft portion of the hull structure, towing means positioned on the aft portion of the hull structure, the relative positioning of propulsion and steering means, keel fin, and towing means provide enhanced maneuverability of the vessel and its towed load, a deck house with bridge positioned in the aft portion of the vessel forward of the towing means and at a substantial distance abaft the bow and the propulsion and steering means, the positioning of said deck house providing improved protection from the seas impinging upon the bow and improved visual surveillance of all exposed decks of the vessels, cargo carrying space positioned forward of the deck house and the towing means thereby avoiding interference between the cargo and the aft running towing cable, said cargo carrying space extending a substantial distance forward of the deck house in proportion to the length of the vessel, said cargo-carrying space comprising a weather deck wherein said weather deck is positioned at a greater elevation above the water line than the elevation of the towing means, said difference in elevation providing improved protection from the seas of the cargo loaded atop the weather deck while enhancing maneuverability by locating the towing means closer to the water line.

2. A vessel according to claim 1 wherein said weather deck is situated above a cargo hold such that cargo may be carried both within the hold and upon the weather deck.

3. A vessel according to claim 1 in which anchor handling means are provided in the aft portion of the vessel in the area of the towing means.

* * * * *